US007397334B2

(12) United States Patent
Yoshida et al.

(10) Patent No.: US 7,397,334 B2
(45) Date of Patent: Jul. 8, 2008

(54) COIL COMPONENT AND METHOD OF MANUFACTURING THE SAME

(75) Inventors: Makoto Yoshida, Tokyo (JP); Nobuyuki Okuzawa, Tokyo (JP); Tomokazu Ito, Tokyo (JP); Yukari Hishimura, Tokyo (JP); Yoshikazu Sato, Tokyo (JP)

(73) Assignee: TDK Corporation, Tokyo (JP)

( * ) Notice: Subject to any disclaimer, the term of this patent is extended or adjusted under 35 U.S.C. 154(b) by 27 days.

(21) Appl. No.: 11/052,933

(22) Filed: Feb. 9, 2005

(65) Prior Publication Data

US 2005/0184848 A1 Aug. 25, 2005

(30) Foreign Application Priority Data

Feb. 25, 2004 (JP) ..... 2004-049903

(51) Int. Cl.
*H01F 5/00* (2006.01)

(52) U.S. Cl. ..... 336/200; 336/223; 336/232; 29/602.1

(58) Field of Classification Search ..... 336/200, 336/223, 232
See application file for complete search history.

(56) References Cited

U.S. PATENT DOCUMENTS 4,416,056 A * 11/1983 Takahashi ..... 29/603.24
5,065,270 A * 11/1991 Koyanagi et al. ..... 360/123
6,181,232 B1 * 1/2001 Kitamura ..... 336/200
6,207,466 B1 * 3/2001 Kamijima ..... 438/3
6,593,841 B1 7/2003 Mizoguchi et al.
6,710,694 B2 3/2004 Matsuta et al.
6,831,543 B2 * 12/2004 Mizoguchi et al. ..... 336/200

FOREIGN PATENT DOCUMENTS

| | | | |
|---|---|---|---|
| JP | 04-363006 | | 12/1992 |
| JP | 06180821 A | * | 6/1994 |
| JP | B2 07-048416 | | 5/1995 |
| JP | B2 2677415 | | 7/1997 |
| JP | A 11-054326 | | 2/1999 |
| JP | A 2000-182213 | | 6/2000 |
| JP | B2 3086212 | | 7/2000 |
| JP | A 2003-133135 | | 5/2003 |

* cited by examiner

*Primary Examiner*—Anh Mai
(74) *Attorney, Agent, or Firm*—Oliff & Berridge, PLC

(57) ABSTRACT

The invention relates to a coil component used as a main component of a common mode choke coil or a transformer and a method of manufacturing the same, and the invention is aimed at providing a coil component with a small size and a low height having high differential transmission characteristics and a method of manufacturing the same. A common mode choke coil has a configuration in which an insulation film, a coil conductor, another insulation film, another coil conductor and another insulation film are stacked in the order listed between magnetic substrates provided opposite to each other. The coil conductors have a coil section which is in a trapezoidal general configuration. A top portion of the coil section is formed in a convex configuration such that it bulges in the form of a convex, and a bottom portion of the coil section is formed in a planar configuration.

8 Claims, 8 Drawing Sheets

COIL COMPONENT AND METHOD OF MANUFACTURING THE SAME

BACKGROUND OF THE INVENTION

1. Field of the Invention

The present invention relates to a coil component used as a main component of a common mode choke coil or a transformer and a method of manufacturing the same.

2. Description of the Related Art

Reductions in the size of electronic apparatus such as personal computers and portable phones have resulted in demand for reductions in the size and thickness (low height) of electronic components such as coils and capacitors mounted on internal circuits of electronic apparatus.

However, a wire-wound coil obtained by winding a copper wire or the like around a ferrite core has a problem in that it is difficult to make compact because of structural limitations. Under the circumstance, research and development is active on chip-type coil components which can be provided with a small size and a low height. Known chip-type coil components include multi-layer type coil components provided by forming coil conductor patterns on surfaces of magnetic sheet made of ferrite or the like and stacking the magnetic sheets and thin film type coil components provided by forming insulation films and coil conductors constituted by metal thin films alternately using thin film forming techniques.

Patent Documents 1 to 3 disclose common mode choke coils that are thin film type coil components. FIG. 10 is a sectional view of a common mode choke coil 51 taken along a plane including center axes of coil conductors 59 and 61. As shown in FIG. 10, the common mode choke coil 51 has an insulation layer 57 formed by stacking an insulation film between ferrite substrates (magnetic substrates) 53 and 55 which are provided opposite to each other. The coil conductors 59 and 61, which are provided opposite to each other with the insulation film interposed between them and formed in a spiral configuration, are embedded in the insulation layer 57. The insulation layer 57 and the coil conductors 59 and 61 are formed in the order listed using thin film forming techniques.

An open region 63 is formed on an inner peripheral side of the coil conductors 59 and 61 having a spiral configuration by removing the insulation layer 57. An open region 65 is formed on an outer peripheral side of the spiral coil conductors 59 and 61 by removing the insulation layer 57. Magnetic layers 67 are formed to fill the open regions 63 and 65. Further, a bonding layer 69 is formed on the magnetic layers 67 and the insulation layer 57 to bond a magnetic substrate 55.

When the coil conductors 59 and 61 are energized, a magnetic path M is formed such that it passes through the magnetic substrate 53, the magnetic layer 67 in the open region 63, the bonding layer 69, the magnetic substrate 55, the bonding layer 69 again and the magnetic layer 67 in the open region 65 in the section including the center axes of the coil conductors 59 and 61. The bonding layer 69 is a film having a thickness on the order of a few μm, although it is non-magnetic. Therefore, substantially no leakage of the magnetic flux occurs in this part, and the magnetic path M may be regarded as a substantially closed path.

In order to improve differential transmission (balanced transmission) characteristics of the common mode choke coil 51, a capacitance (stray capacitance) C which is generated between the coil conductors 59 and 61 must be made small. The capacitance C is parasitically generated in parallel with inductances of the coil conductors 59 and 61. Therefore, when a relatively high capacitance C is generated, the capacitance C will dominantly constitute the impedance of the common mode choke coil 51 in high frequency bands. Since the impedance constituted by the capacitance C is inversely proportionate to a frequency, the impedance of the common mode choke coil 51 decreases, which results in degradation of differential transmission characteristics.

The capacitance C between the coil conductors 59 and 61 can be expressed by $C=\epsilon\times(S/d)$ where d represents the inter-layer distance between the coil conductors 59 and 61; S represents the area in which the conductors face each other; and $\epsilon$ represents the dielectric constant of the region between the coil conductors 59 and 61 (the dielectric constant of the insulation layer 7). Since section of the coil conductors 59 and 61 are formed with a rectangular configuration, the area S over which the coil conductors 59 and 61 face each other is relatively large. Further, the coil conductors 59 and 61 are formed such that the inter-layer distance d between them becomes very small to provide the common mode choke coil 51 with a low height and to maintain predetermined common mode filter characteristics. As a result, a relatively high capacitance C is generated between the coil conductors 59 and 61, and differential transmission characteristics are therefore degraded.

Patent Document 4 discloses a pair of coils disposed in a face-to-face relationship and having a sectional configuration in which corners of the coils are rounded. In comparison to coils having a rectangular section like the coil conductors 59 and 61, the area over which the coils having a sectional configuration with rounded corners face each other at a minimum inter-layer distance between them is smaller, therefore a capacitance generated between the upper and the lower coils become a slightly lower. However, since the area over which the upper and the lower coils face each other at a minimum inter-layer distance is still relatively large in spite of the fact that the coil section has rounded corners, the differential transmission characteristics of the coils cannot be sufficiently improved.

Patent Documents 5 to 7 disclose sectional configurations of a pair of coils provided in a face-to-face relationship in a thin film magnetic head. Surfaces of such coils facing each other are curved or formed in a trapezoidal configuration when viewed in their sections. Since the purpose of such sectional configurations is to achieve effects such as a reduction in the magnetic path length between the magnetic poles of a thin film magnetic head, conductive parts of the upper and lower coils are interleaved between each other, and there are fundamental structural differences between those coils and the common mode choke coil 51, including a difference in wiring between upper and lower coils, i.e., series and parallel wiring.

Patent Document 1: Japanese Patent Laid-Open No. JP-A-2003-133135

Patent Document 2: Japanese Patent Laid-Open No. JP-A-11-54326

Patent Document 3: Japanese Patent Application No. 2003-307372

Patent Document 4: Japanese Patent No. 2011372

Patent Document 5: Japanese Patent No. 2677415

Patent Document 6: Japanese Patent Laid-Open No. JP-A-2000-182213

Patent Document 7: Japanese patent No. 3086212

To reduce the height of the common mode choke coil 51 and maintain predetermined common mode filter characteristics, the inter-layer distance d between the coil conductors 59 and 61 must be reduced. As a result, a relatively high capacitance C is generated between the coil conductors 59 and 61, which results in a problem in that the differential transmission characteristics cannot be sufficiently improved.

SUMMARY OF THE INVENTION

It is an object of the invention to provide a compact and low-height coil component having high differential transmission characteristics and a method of manufacturing the same.

The above object is achieved by a coil component characterized in that it has a first coil conductor which is formed on a magnetic substrate and a second coil conductor which is formed directly above the first coil conductor with an insulation film interposed between them and whose bottom portion, in a section of the coil, has a width different from a width of a top portion of the first coil conductor in a coil section.

The coil component according to the invention is characterized in that the first coil conductor is in a convex configuration in the middle of the top portion thereof when viewed in the coil section.

The coil component according to the invention is characterized in that the top portion of the first coil conductor is in a planar configuration when viewed in the coil section.

The coil component according to the invention is characterized in that the bottom portion of the second coil conductor is in a planar configuration when viewed in the coil section.

The above object is achieved by a method of manufacturing a coil component characterized in that it has the steps of forming a first coil conductor on a magnetic substrate, forming an insulation film on the first coil conductor and forming a second coil conductor on the insulation film, a bottom portion of the second coil conductor, in a section of the coil, having a width different from a width of a top portion of the first coil conductor in a coil section.

The method of manufacturing a coil component according to the invention is characterized in that the first and second coil conductors are formed using a frame plating process.

The method of manufacturing a coil component according to the invention is characterized in that it has the steps of forming resist frames which have side faces located in a plane in parallel with the coil section and inclined at a predetermined angle and forming at least either of the first and second coil conductors between the resist frames.

The method of manufacturing a coil component according to the invention is characterized in that the predetermined angle is in the range from 5° to 30°.

The present invention makes it possible to manufacture a compact and low-height coil component having high differential transmission characteristics.

DESCRIPTION OF THE PREFERRED EMBODIMENT

Figure 1:
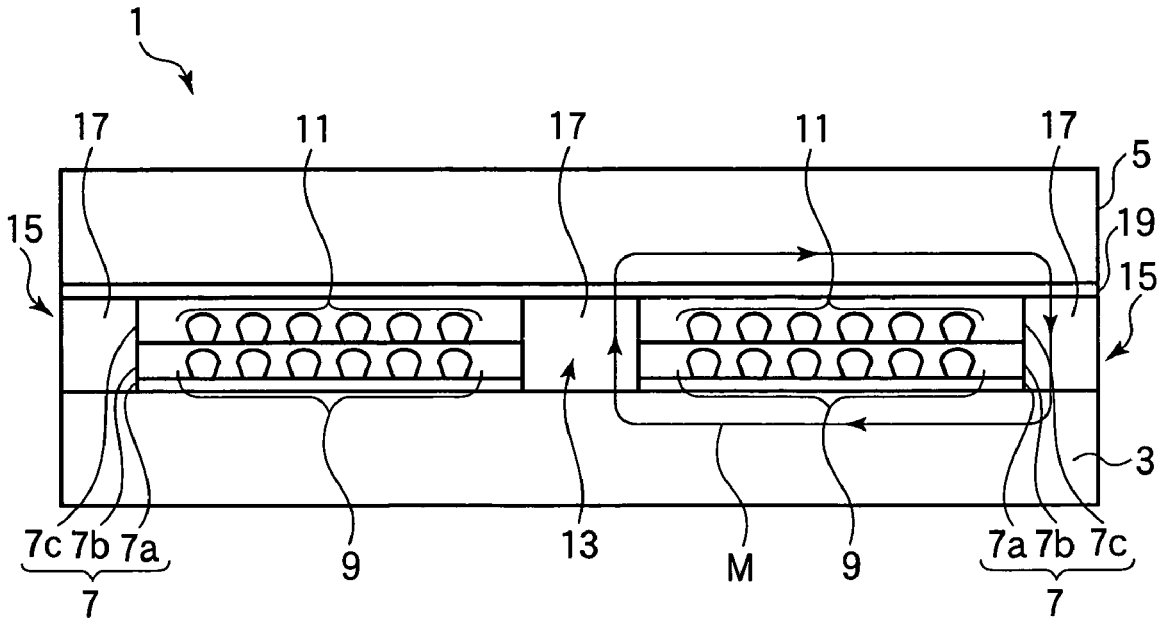
FIG. 1 is a sectional view of a common mode choke coil 1 according to an embodiment of the invention.

A coil component and a method of manufacturing the same according to an embodiment of the invention will now be described with reference to FIGS. 1 to 9. By way of example, the present embodiment will be described with reference to a common mode choke coil in which a common mode current that can cause electromagnetic interference is suppressed in a balanced transmission method is employed as a coil component. First, a configuration of a common mode choke coil 1 will now be described using FIG. 1. FIG. 1 shows a section of the common mode choke coil 1 taken along a plane including center axes of coil conductors 9 and 11.

As shown in FIG. 1, the common mode choke coil 1 of the present embodiment comprises an insulation film 7*a* formed of polyimide resin on a magnetic substrate 3 formed of ferrite, a coil conductor (first coil conductor) 9 having a spiral configuration formed of a conductive material, another insulation film 7*b* formed of polyimide resin, another coil conductor (second coil conductor) 11 having a spiral configuration formed of a conductive material and another insulation film 7*c* formed of polyimide resin, the elements being stacked in the order listed. As will be apparent from above, the coil conductors 9 and 11 are embedded in an insulation layer 7 constituted by the insulation films 7*a* to 7*c*.

The coil conductor 11 is disposed directly above the coil conductor 9 in a face-to-face relationship therewith with the insulation film 7*b* interposed between them. Planes of the coil conductors 9 and 11 orthogonal to the direction of a flow of a current through the conductors (sections of the coils) have a trapezoidal general configuration. The top portions of the coil sections are formed in a convex configuration such that they bulge in the middle, and the bottom portions of the coil sections are formed in a planar configuration. The width of the top portions of the coil sections is longer than the width of the bottom portions of the coil sections. Therefore, the inter-layer distance between the coil conductors 9 and 11 is shortest when measured at the convexes of the top portions of the coil section of the coil conductor 9 and gradually increases from the value at the convexes toward both sides of the top portions. Thus, a capacitance (stray capacitance) generated between the coil conductors 9 and 11 decreases, and differential transmission (balanced transmission) characteristics are therefore improved.

An open region 13 is formed on an inner peripheral side of the coil conductors 9 and 11 by removing the insulation layer 7. An open region 15 is formed on an outer peripheral side of the coil conductors 9 and 11 by removing the insulation layer 7. A magnetic layer 17 is formed such that it fills the open regions 13 and 15 to improve the degree of magnetic coupling between the coil conductors 9 and 11 and to improve impedance characteristics through an increase in common impedance. The magnetic layer 17 is formed of a composite ferrite obtained by mixing magnetic powder made of ferrite in polyimide resin. Further, a bonding layer 19 is formed on the magnetic layer 17 and the insulation film 7*c* to bond a magnetic substrate 5 formed of ferrite.

An operation of the common mode choke coil 1 of the present embodiment will now be described. When the coil conductors 9 and 11 are energized, as shown in FIG. 1, a magnetic path M is formed in a section including center axes of the coil conductors 9 and 11, the magnetic path passing through the magnetic substrate 3, the magnetic layer 17 in the open region 13, the bonding layer 19, the magnetic substrate 5, the bonding layer 19 again and the magnetic layer 17 in the open region 15 in the order listed (or in the reverse order). The bonding layer 19 is a thin film having a thickness on the order of a few μm, although it is non-magnetic. Therefore, substantially no leakage of the magnetic flux occurs in this part, and the magnetic path M can be regarded as a substantially closed path.

Figure 2A:
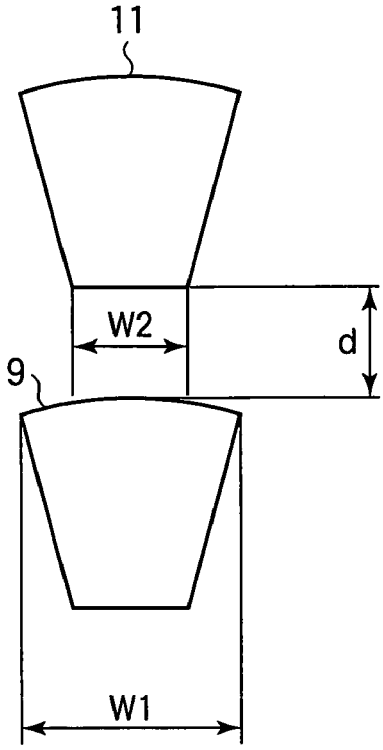
FIGS. 2A to 2C are sectional views of the common mode choke coil 1 according to the embodiment of the invention taken at manufacturing steps.
Figure 2B:
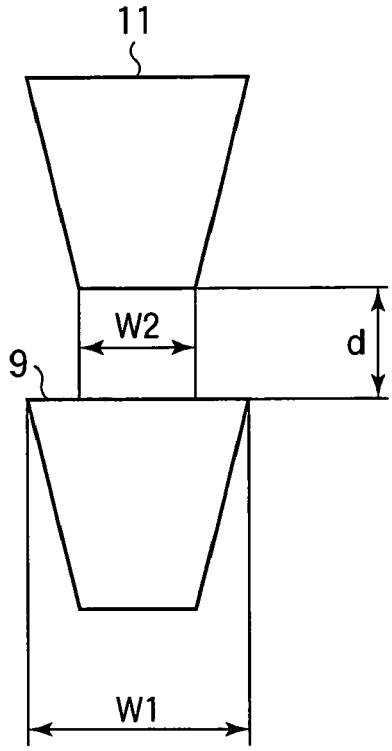
Figure 2C:
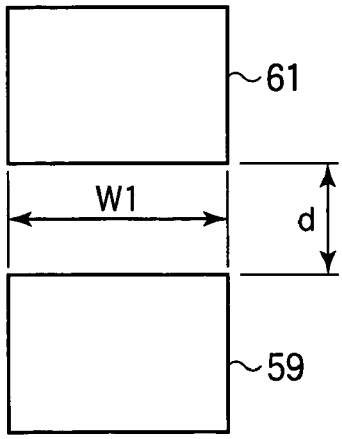

Next, a relationship between sectional configurations of coils and a capacitance between the coil conductors will be described with reference to FIGS. 2A to 2C. FIGS. 2A to 2C show three types of configurations of coil sections. FIG. 2A shows sections of the coils in the present embodiment. FIG. 2B shows sections of coils formed in a trapezoidal configuration in a second modification of the present embodiment to be described later. FIG. 2C shows sections of coils formed in a rectangular configuration according to the related art. The three types of coil sections in FIGS. 2A to 2C have the same sectional area, so that the coils have the same resistance.

Referring to FIG. 2B, since the coil sections of the coil conductors 9 and 11 have a trapezoidal configuration in which the top portions of the coil sections have a width W1 and the bottom portions of the coil sections have a width W2 (W2<W1), the conductors face each other over the width W2 at an inter-layer distance d. A capacitance C' between the coil conductors 9 and 11 can be expressed by $C'=(\epsilon \times L/d)\times W2$ where L represents the length of the coil conductors 9 and 11 in a direction normal to the plane of the drawing and $\epsilon$ represents the dielectric constant of the region between the coil conductors 9 and 11.

Meanwhile, referring to FIG. 2C, since the coil sections of the coil conductors 59 and 61 according to the related art have a rectangular configuration, the conductors face each other over the width W1 at an inter-layer distance d. A capacitance C between the coil conductors 59 and 61 can be expressed by $C=(\epsilon \times L/d)\times W1$ where L represents the length of the coil conductors 59 and 61 in a direction normal to the plane of the drawing and $\epsilon$ represents the dielectric constant of the region between the coil conductors 59 and 61.

Since a capacitance between coil conductors is proportionate to the width over which the conductors face each other at an inter-layer distance d as thus described, the capacitance between the coil conductors 9 and 11 is decreased by forming the conductors with coil sections in a trapezoidal configuration. For example, a capacitance ratio C'/C equals 0.777/1.786 where W1=103.5; W2=53.6; and d=50. Thus, the capacitance can be reduced by about 57% by providing the coils with a trapezoidal configuration. When the top portions of coil sections have a convex configuration as shown in FIG. 2A, only the vertex of the convex constitutes the width over which the coils face each other at an inter-layer distance d, and the inter-layer distance between the coil conductors 9 and 11 gradually increases from the value at the convex toward both sides of the coils. As a result, a capacitance generated between the coil sections will be smaller than the capacitance C' in the case of a trapezoidal configuration, and improved further differential transmission characteristics.

As thus described, the capacitance C' generated between the coil conductors 9 and 11 can be made small by forming the coils with sections in a substantially trapezoidal configuration such that top portions thereof bulge in the form of convexes even if the inter-layer distance d between the coil conductors 9 and 11 is small. As a result, the common mode choke coil 1 exhibits sufficient impedance against high frequency signals and improved differential transmission characteristics, and it can be provided with a small size and a low height.

A method of manufacturing a common mode choke coil 1 according to the present embodiment will now be described with reference to FIGS. 3A to 6B. FIGS. 3A to 6B are sectional views of the common mode choke coil 1 taken at manufacturing steps along a plane including center axes of the coil conductors 9 and 11. Elements having effects and functions similar to those of the elements of the common mode choke coil 1 shown in FIG. 1 are indicated by like reference numerals and will not be described.

Figure 3A:
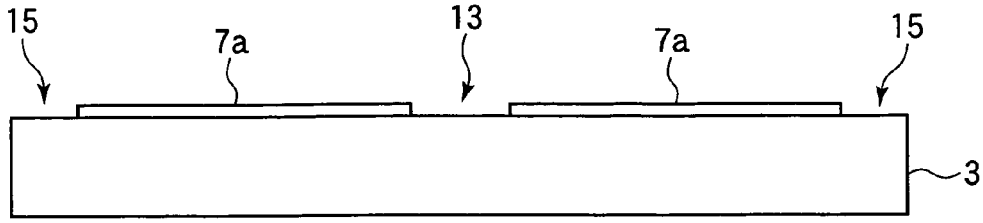
FIGS. 3A to 3D are sectional views of the common mode choke coil 1 according to the embodiment of the invention taken at manufacturing steps.

First, as shown in FIG. 3A, polyimide resin is applied to a thickness of 7 to 8 μm on a magnetic substrate 3 formed of ferrite, and an insulation film 7*a* is formed by patterning the polyimide resin. The insulation film 7*a* is formed by opening open regions 13 and 15. Next, a frame plating process is used to form a coil conductor 9. The frame plating process is a method of forming a plating film using a mold (frame) formed by patterning a resist layer.

Figure 3B:
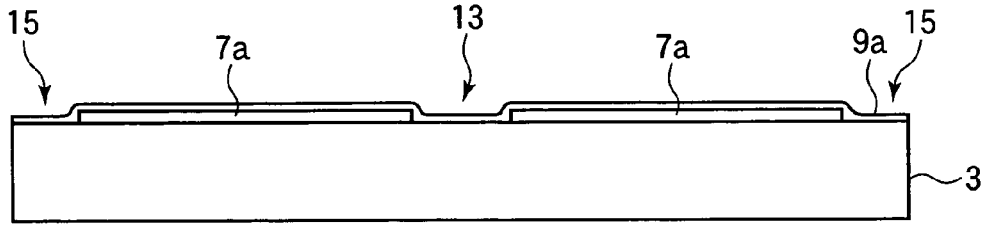

As shown in FIG. 3B, an electrode film 9*a* is formed on the entire surface using a sputtering process or evaporation process. A bonding layer constituted by two layers, e.g., a chromium (Cr) film having a thickness of 50 nm and a titanium (Ti) film having a thickness of 100 nm, may be formed under the electrode film 9*a* to improve the tightness of the bonding of the same to the insulation film 7*a*. The electrode film 9*a* is preferably made of the same material as the metal material to be plated, although there is no problem as long as the material has conductivity.

Figure 3C:
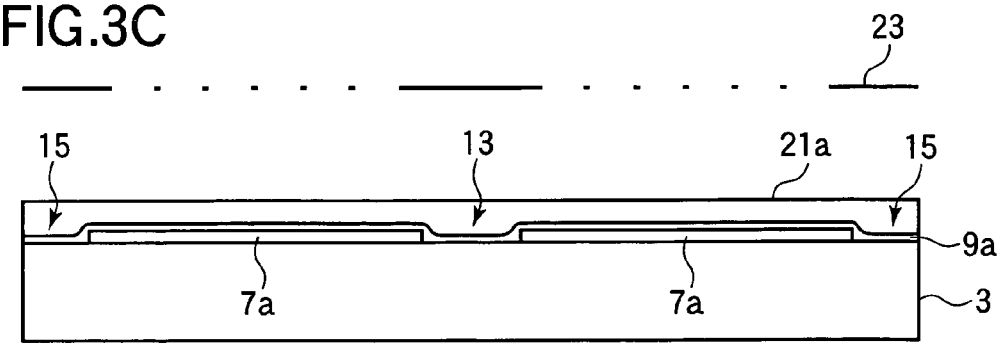

Next, as shown in FIG. 3C, a resist layer 21*a* is formed by applying a positive resist on the entire surface, and a prebaking process is performed on the resist layer 21*a* as occasion demands. Next, the resist layer 21*a* is exposed by irradiating it with exposure light through a mask 23 having a pattern of the coil conductor 9 drawn thereon. As will be described later, the resist layer 21*a* is exposed by, for example, optimizing exposure conditions such that side faces of resist frames 21*b* are inclined at a predetermined angle in a plane in parallel with the coil section.

Figure 3D:
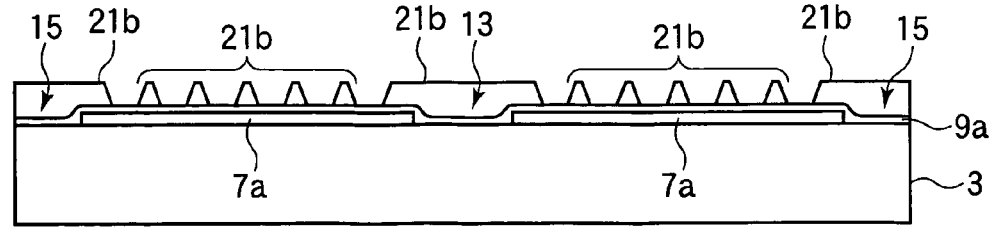

Then, development is performed using an alkali developing solution after performing a thermal process as occasion demands. For example, a tetramethyl ammonium hydrooxide (TMAH) in a predetermined concentration is used as the alkali developing solution. Next, the developing step is then followed by a cleaning step. The developing solution in the resist layer 21*a* is cleaned away using a cleaning fluid such as pure water, the developing and dissolving reaction of the resist layer 21*a* is stopped, and as shown in FIG. 3D, resist frames 21*b* patterned in the shape of the coil conductor 9 are formed. The resist frames 21*b* are formed such that their side faces are inclined at an angle of 5° to 30° (about 30° in the present embodiment) where it is assumed that a direction normal to the plane of the magnetic substrate 3 is at 0° and that the angle increases in a direction in which the side faces of the resist frames 21*b* face in the opposite direction to the plane of the magnetic substrate 3 (upward in the figure).

Figure 4A:
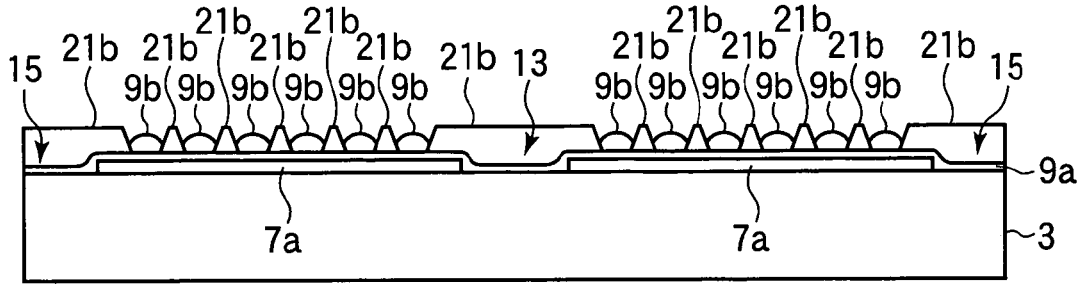
FIGS. 4A to 4C are sectional views of the common mode choke coil 1 according to the embodiment of the invention taken at manufacturing steps.
Figure 4B:
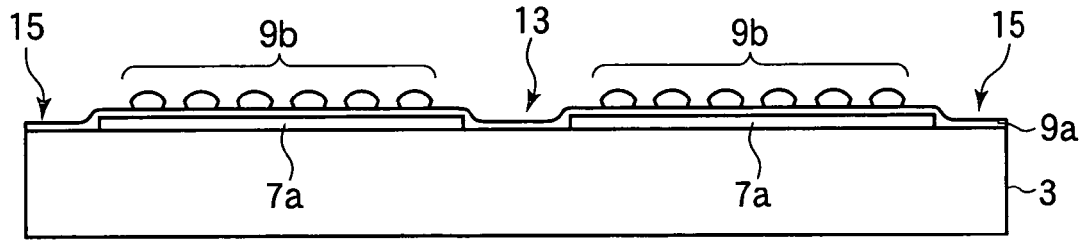
Figure 4C:
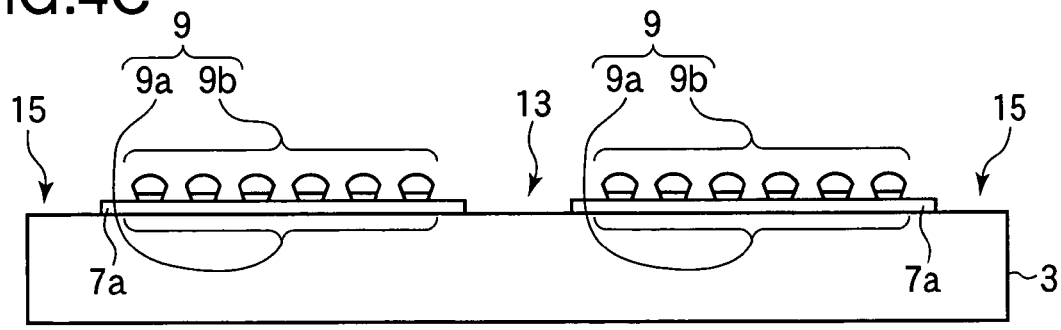

When the cleaning is completed, the cleaning fluid is scattered away to dry the substrate. The magnetic substrate 3 may be heated to dry up the cleaning fluid if necessary. Next, the magnetic substrate 3 is dipped in a plating solution in a plating bath, a plating process is performed using the resist frames 21*a* as a mold, and a plating film 9*b* is formed in gaps in the resist frames 21*b* as shown in FIG. 4A. The plating film 9*b* has a substantially trapezoidal sectional configuration such that top portions thereof bulge in the form of convexes in the middle thereof. Next, as shown in FIG. 4B, the resist frames 21*b* are removed from the electrode film 9*a* using an organic solvent after washing and drying the same as occasion demands. Next, as shown in FIG. 4C, the electrode film 9*a* is removed by performing dry etching (ion milling or reactive ion etching (RIE), etc.) or wet etching using the plating films 9*b* as a mask. Thus, a coil conductor 9 constituted by the electrode film 9*a* and the plating film 9*b* having a substantially trapezoidal coil section is formed. The magnetic substrate 3 is exposed at the open regions 13 and 15 because the electrode film 9*a* is dry-etched.

Figure 5A:
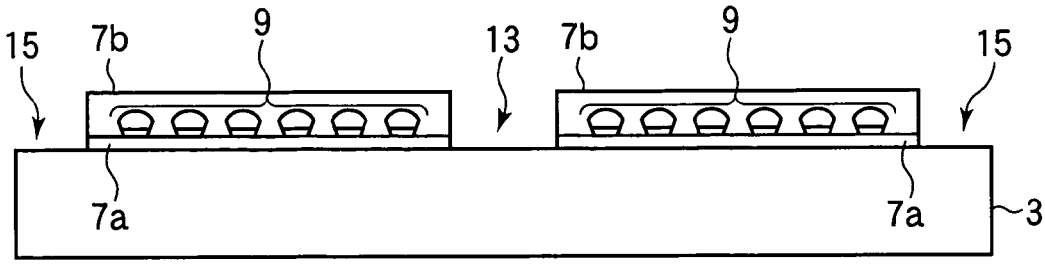
FIGS. 5A to 5C are sectional views of the common mode choke coil 1 according to the embodiment of the invention taken at manufacturing steps.
Figure 5B:
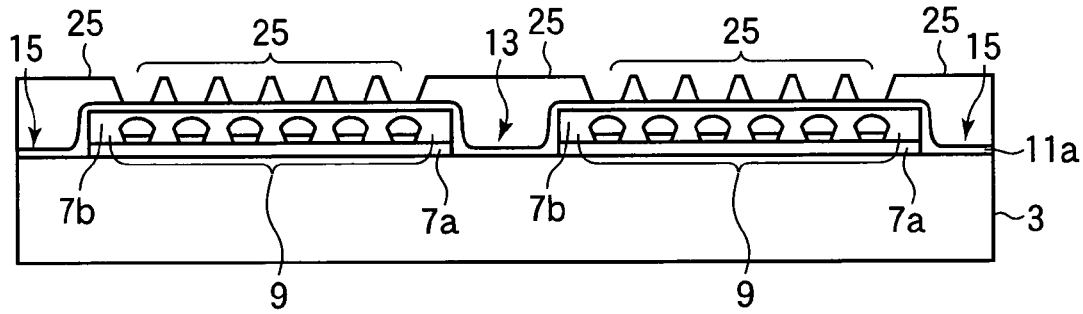

When the coil conductor 9 is formed using a frame plating process, as shown in FIG. 5A, polyimide resin is applied to the entire surface and an insulation film 7*b* is formed by patterning the polyimide resin, the insulating film 7*b* is then cured. The insulation film 7*b* has a substantially planar configuration on its top surface, and it is formed by opening the open regions 13 and 15. Next, a coil conductor 11 is formed on the insulation film 7*b* using a frame plating process. An electrode film 11*a* is formed on the entire surface as shown in FIG. 5B. A positive resist is then applied to the entire surface and patterned using a mask (not shown) having a pattern of the coil conductor 11 drawn thereon, resist frames 25 which are patterned in the shape of the coil conductor 11 are formed. Similarly to the resist frames 21*b*, the resist frames 25 are formed such that they have side faces inclined at 5° to 30° (about 30° in the present embodiment). The resist frames 25 are formed between adjoining conductors of the coil conductor 9 and at the open regions 13 and 15 such that the coil conductor 11 will be formed directly above the coil conductor 9 with the insulation film 7*b* interposed between them.

Figure 5C:
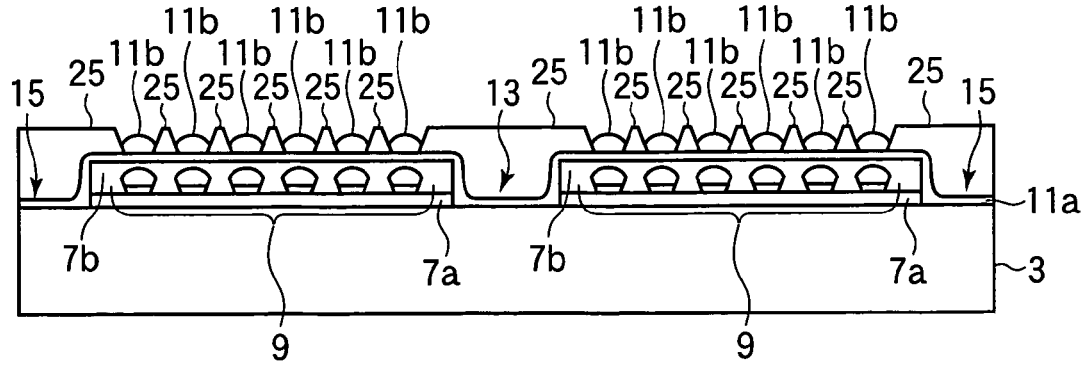
Figure 6A:
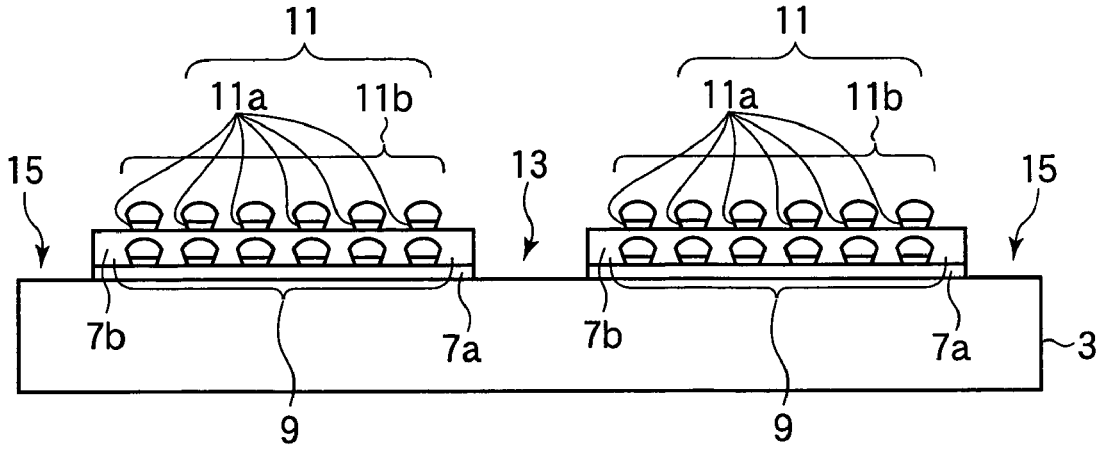
FIGS. 6A and 6B are sectional views of the common mode choke coil 1 according to the embodiment of the invention taken at manufacturing steps.

Next, the magnetic substrate 3 is dipped in a plating solution in a plating bath, a plating process is performed using the resist frames 25 as a mold, and a plating film 11*b* is formed in gaps in the resist frames 25 as shown in FIG. 5C. The top surface of the insulation film 7*b* is in a planar configuration, and the side faces of the resist frames 25 are inclined. Therefore, the plating film 11*b* has a substantially trapezoidal sectional configuration such that top portions thereof bulge in the form of convexes in the middle thereof. Next, as shown in FIG. 6A, the resist frames 25 are removed from the electrode film 11*a* using an organic solvent, and the electrode film 11*a* is removed by performing dry etching or wet etching using the plating film 11*b* as a mask. Thus, a coil conductor 11 constituted by the electrode film 11*a* and the plating film 11*b* having a substantially trapezoidal coil section is formed. Top portions of the coil section of the coil conductor 9 are in a convex configuration, and bottom portions of the coil conductor 11 in the coil section are planer and shorter. Therefore, the conductive surfaces of the coil conductors 9 and 11 facing each other at a minimum distance between the coils become small. The magnetic substrate 3 is exposed at the open regions 13 and 15 because the electrode film 11*a* is dry-etched.

Figure 6B:
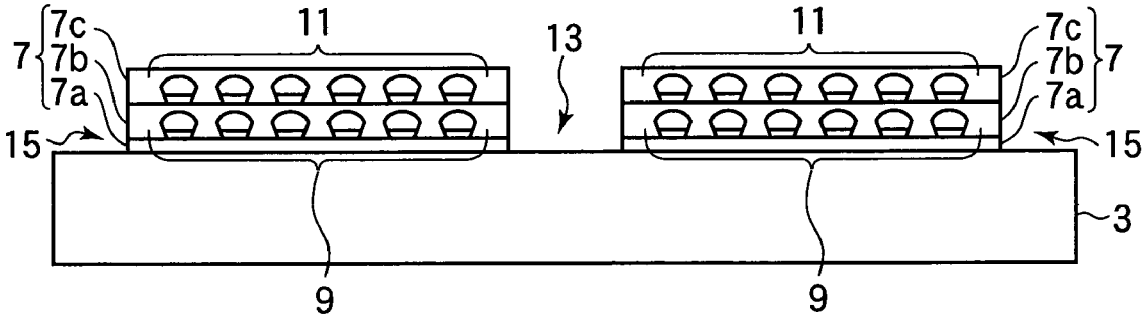

Next, as shown in FIG. 6B, polyimide resin is applied to the entire surface, an insulation film 7*c* is formed by patterning the polyimide resin, and it is then cured. The insulation film 7*c* is formed by opening the open regions 13 and 15. Thus, an insulation layer 7 constituted by the insulation films 7*a* to 7*c* is formed, the coil conductors 9 and 11 being embedded in the insulation layer.

Next, although not shown, a magnetic layer 17 is formed by filling the open regions 13 and 15 with a composite ferrite obtained by mixing magnetic powder made of ferrite in polyimide resin. A bonding layer 19 is formed by applying a bonding agent on the magnetic layer 17 in the open regions 13 and 15 and the insulation film 7*c*. Next, a magnetic substrate 5 is secured on the bonding layer 19.

Next, external electrodes (not shown) in connection with the coil conductors 9 and 11 are formed on sides of the magnetic substrates 3 and 5 opposite to each other such that they extend substantially perpendicularly to the substrate surfaces and across the magnetic substrates 3 and 5. A common mode choke coil 1 as shown in FIG. 1 is thus completed.

As described above, according to the method of manufacturing the common mode choke coil 1 in the present embodiment, the use of the resist frames 21*b* and 25 having side faces inclined at a predetermined angle make it possible to form the coil conductors 9 and 11 having a substantially trapezoidal coil section in which top portions bulge in the form of convexes in the middle thereof. Since this reduces the inter-layer distance d between the coil conductors 9 and 11 and makes the conductive surfaces facing each other at the inter-layer distance d smaller, the capacitance C' generated between the coil conductors 9 and 11 is decreased and the common mode choke coil 1 is provided with improved differential transmission characteristics.

Figure 7:
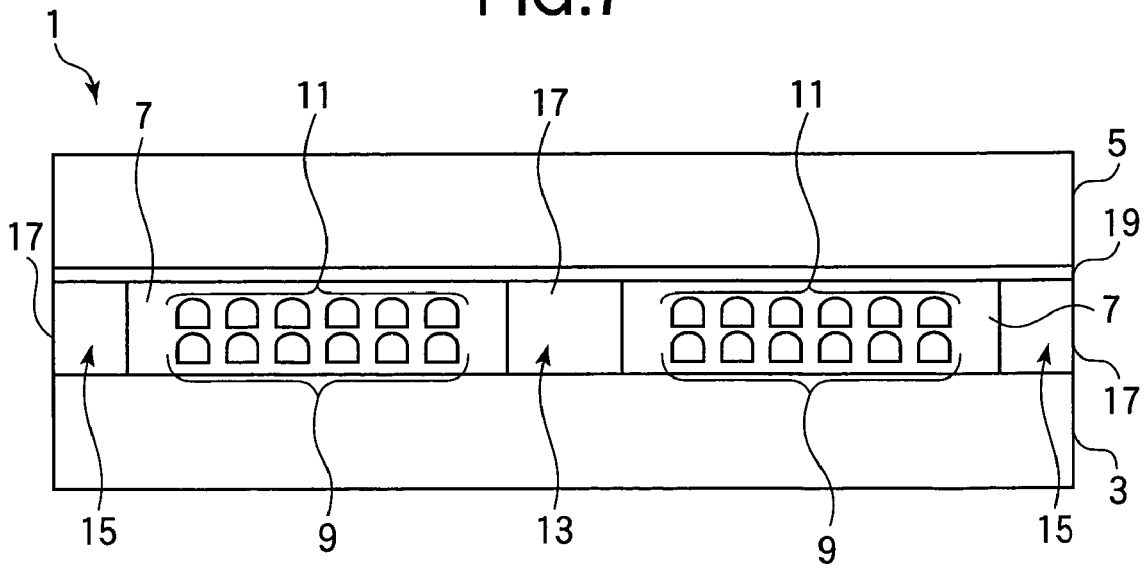
FIG. 7 is a sectional view of a first modification of the common mode choke coil 1 according to the embodiment of the invention taken along a plane including center axes of coil conductors 9 and 11.

A first modification of the present embodiment will now be described with reference to FIG. 7. In the coil component and the method of manufacturing the same in the above-described embodiment, the coil conductors 9 and 11 have a substantially trapezoidal coil section in which top portions bulge in the form of convexes in the middle thereof. In the present modification, the coil conductors 9 and 11 are characterized in that they have a substantially rectangular coil section in which top portions thereof bulge in the form of convexes in the middle thereof. FIG. 7 shows a section of the common mode choke coil 1 taken along a plane including center axes of the coil conductors 9 and 11.

As shown in FIG. 7, the top portions of the coil section of the coil conductor 9 are formed in a curved configuration such that they bulge in the form of convexes in the middle thereof. On the contrary, bottom portions of the coil section of the coil conductor 11 are formed in a planar configuration. Since the coil conductors 9 and 11 therefore face each other at small conductive surfaces thereof at a minimum inter-layer distance, the same effects as described above can be achieved.

Figure 8:
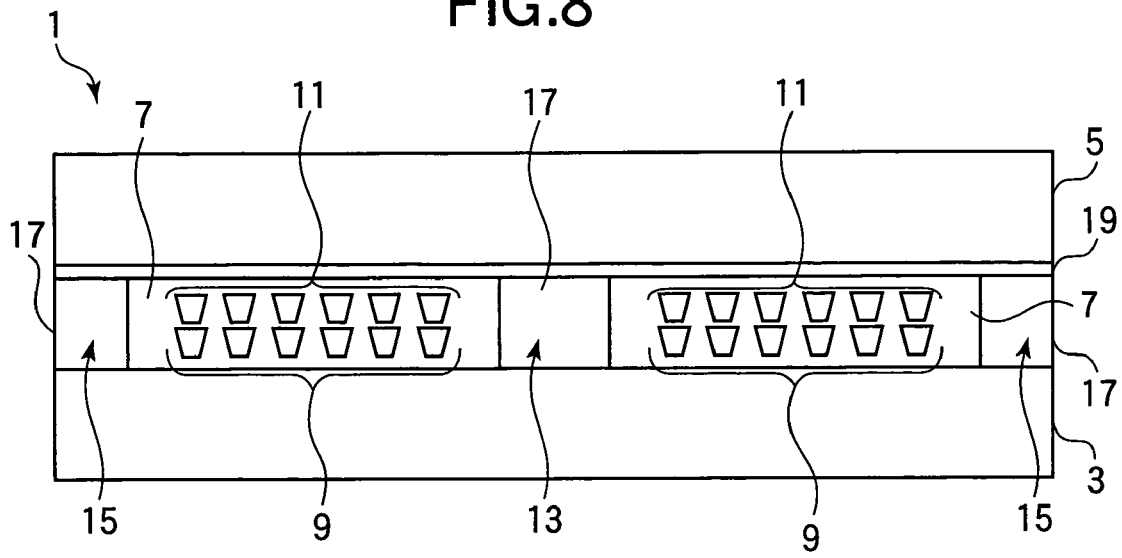
FIG. 8 is a sectional view of a second modification of the common mode choke coil 1 according to the embodiment of the invention taken along a plane including center axes of coil conductors 9 and 11.

A second modification of the present embodiment will now be described with reference to FIG. 8. In the coil component and the method of manufacturing the same in the above-described embodiment, the coil conductors 9 and 11 have a substantially trapezoidal coil section in which top portions bulge in the form of convexes in the middle thereof. In the present modification, the coil conductors 9 and 11 are characterized in that they have a trapezoidal coil section. FIG. 8 shows a section of the common mode choke coil 1 taken along a plane including center axes of the coil conductors 9 and 11.

As shown in FIG. 8, top portions of the coil sections of the coil conductors 9 and 11 are formed with a width greater than the width of bottom portions. Both of the top and bottom portions of the coil sections of the coil conductors 9 and 11 are formed in a planar configuration. The top portions of the coil sections of the coil conductors 9 and 11 may be planarized using a chemical mechanical polishing process (CMP process) or adding a predetermined additive to the plating solution in the plating bath. As described with reference to FIG. 2B, since the coil conductors 9 and 11 having a trapezoidal coil section face each other at small conductive surfaces thereof at the inter-layer distance d, the same effects as described above can be achieved.

Figure 9:
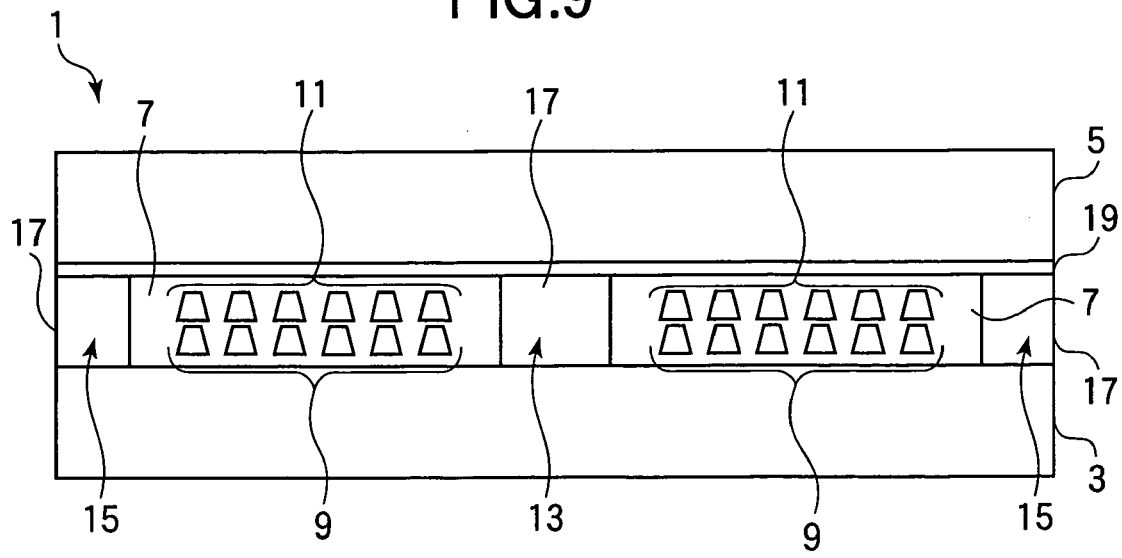
FIG. 9 is a sectional view of a third modification of the common mode choke coil 1 according to the embodiment of the invention taken along a plane including center axes of coil conductors 9 and 11.
Figure 10:
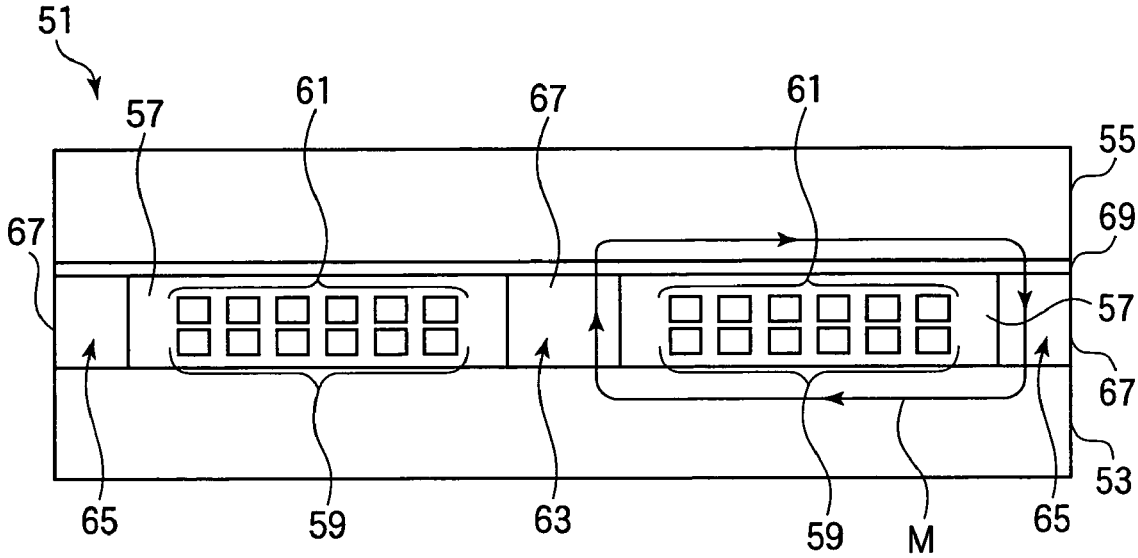
FIG. 10 is a sectional view of a common mode choke coil 51 according to the related art.

A third modification of the present embodiment will now be described with reference to FIG. 9. In the coil component and the method of manufacturing the same in the above-described embodiment, the coil conductors 9 and 11 have a substantially trapezoidal coil section in which top portions bulge in the form of convexes in the middle thereof. In the present modification, coil conductors 9 and 11 are characterized in that they have a trapezoidal coil section oriented in the opposite direction to that shown in the second modification. FIG. 9 shows a section of the common mode choke coil 1 taken along a plane including center axes of the coil conductors 9 and 11.

As shown in FIG. 9, the top portions of the coil sections of the coil conductors 9 and 11 are formed with a width shorter than the width of bottom portions. Resist frames having side faces inclined toward the plane of the magnetic substrate 3 can be formed by optimizing exposure conditions using a negative resist. Thus, the coil conductors 9 and 11 can be provided with a trapezoidal coil section in which the length of the top portions is smaller than the length of the bottom portions. The top portions of the coil sections of the coil conductors 9 and 11 are formed in a planar configuration using the same method as in the second modification. The top portions of the coil section of the coil conductor 9 face the bottom portions of the coil section of the coil conductor 11. Since the conductive surfaces facing each other at a minimum inter-layer distance are small, the same effects as described above can be achieved.

The invention is not limited to the above-described embodiment and may be modified in various ways.

While the coil conductors 9 and 11 in the above-described embodiment and the first to third embodiments are formed to have coil sections in the same configuration, this is not limiting the invention. The coil conductors 9 and 11 may have coil sections in different configurations provided that respective resistance values of the coil conductors 9 and 11 become smaller than a predetermined value, that the conductive portions of the coil conductors 9 and 11 face each other and that the top portions of the coil conductor 9 and the bottom portions of the coil conductor 11 are formed with different widths.

For example, as described in the above embodiment and the first modification, the top portions of the coil conductor 11 may have a planar configuration instead of a convex configuration. Further, it is not essential that the bottom portions of the coil conductor 9 are shorter as described in the above embodiment and the second modification. In this case, the same effects as in the above-described embodiment can be achieved.

What is claimed is:

1. A coil component comprising:

a first coil conductor formed on a magnetic substrate;

a second coil conductor formed on the magnetic substrate, wherein the second coil conductor is formed directly above the first coil conductor and has a width of a bottom portion smaller than a width of a top portion of the first coil conductor in a coil section to reduce capacitance between the first and second coil conductors; and an insulating film interposed between the bottom portion of the second coil and the top of the first coil.

2. The coil component according to claim 1, wherein the first coil conductor is in a convex configuration in the middle of the top portion thereof when viewed in the coil section.

3. The coil component according to claim 1, wherein the top portion of the first coil conductor is in a planar configuration when viewed in the coil section.

4. The coil component according to claim 1, wherein the bottom portion of the second coil conductor is in a planar configuration when viewed in the coil section.

5. A method of manufacturing a coil component, comprising:

forming a first coil conductor on a magnetic substrate;

forming an insulation film on the first coil conductor; and forming a second coil conductor on the insulation film directly above the first coil, a bottom portion of the second coil conductor, having a width smaller than a width of a top portion of the first coil conductor in a coil section to reduce capacitance between the first and second coil conductors, wherein the insulating film separates the bottom portion of the second coil and the top portion of the first coil.

6. The method of manufacturing a coil component according to claim 5, wherein the first and second coil conductors are formed using a frame plating process.

7. The method of manufacturing a coil component according to claim 5, comprising:

forming resist frames which have side faces located in a plane in parallel with the coil section and inclined at a predetermined angle; and forming at least either of the first and second coil conductors between the resist frames.

8. The method of manufacturing a coil component according to claim 7, wherein the predetermined angle is in the range from 5° to 30°.

* * * * *